US010989185B1

(12) United States Patent
Myers

(10) Patent No.: US 10,989,185 B1
(45) Date of Patent: Apr. 27, 2021

(54) COVER FOR ECCENTRIC PUSHROD

(71) Applicant: Douglas D. Myers, Jacksonville, FL (US)

(72) Inventor: Douglas D. Myers, Jacksonville, FL (US)

( * ) Notice: Subject to any disclaimer, the term of this patent is extended or adjusted under 35 U.S.C. 154(b) by 0 days.

(21) Appl. No.: 16/839,688

(22) Filed: Apr. 3, 2020

(51) Int. Cl.

| | |
|---|---|
| ***F04B 43/02*** | (2006.01) |
| ***F04B 43/00*** | (2006.01) |
| ***F04B 53/14*** | (2006.01) |
| *F04B 53/10* | (2006.01) |

(52) U.S. Cl.
CPC ..... *F04B 43/026* (2013.01); *F04B 43/0054* (2013.01); *F04B 53/14* (2013.01); *F04B 53/1047* (2013.01)

(58) Field of Classification Search
CPC ..... B23Q 11/00; F04B 43/026; F04B 53/1047
See application file for complete search history.

(56) References Cited

U.S. PATENT DOCUMENTS

| | | | | |
|---|---|---|---|---|
| 3,124,078 | A * | 3/1964 | Hardy | F04B 43/073 417/395 |
| 3,364,870 | A * | 1/1968 | Quatredeniers | F04B 43/02 417/540 |
| 5,044,902 | A * | 9/1991 | Malbec | F04B 43/12 417/477.2 |
| D391,579 | S | 3/1998 | Myers | |
| 8,454,324 | B2 * | 6/2013 | Grapes | F04B 43/06 417/395 |
| 9,121,400 | B1 | 9/2015 | Myers | |

* cited by examiner

*Primary Examiner* — Vicky A Johnson
(74) *Attorney, Agent, or Firm* — Law Office of Mitchell Ghaneie, P.A.; Mitchell Ghaneie; Christopher Roberts

(57) ABSTRACT

This invention is an eccentric pushrod cover device for high-volume double diaphragm pumps which provides protection of the operator from the pushrod during the operation of the pump. The eccentric pushrod cover device is comprised of a mounting plate, top plate, and face plate that are modularly assembled. The modular construction of the eccentric pushrod cover device allows for the device to be retrofitted onto existing pumps and allows for quick access to the pushrod for intermittent maintenance. It is anticipated that the elliptical slotted cutouts could vary in size and orientation.

8 Claims, 6 Drawing Sheets

COVER FOR ECCENTRIC PUSHROD

BACKGROUND OF THE INVENTION

A. Field of the Invention

The present invention relates to a protective cover device for a pair of eccentrically driven pushrods used to actuate a high-volume double diaphragm pump.

B. Prior Art

It is common for a high-volume double diaphragm pump, hereinafter referred to as the pump, to provide a pair of eccentrically driven pushrods to actuate the diaphragm. Typically, each pushrod of the pair of eccentrically driven pushrods is attached at one end to a rotating cam and a high-volume diaphragm at the other. Prior art teaches of providing a cabinet that fully encloses the entire pump. However, fully enclosing the entire pump can inhibit access to various parts and components of the pump that often require routine maintenance. Furthermore, retrofitting existing pumps with protective covers for eccentric pushrods is not possible without modification of the configuration of the pump's parts and components to accommodate the protective cover device.

Currently, unenclosed pumps leave the pair of eccentrically driven pushrods exposed while the pump is in use. Such exposure of the pushrods while the pump is in use creates the risk of significant physical harm to one or more operators working in the general vicinity of the pump.

The unique and novel exemplary embodiment for the eccentric pushrod cover device disclosed herein provides a solution that protects the operator from the eccentric pushrod during operation of an unenclosed pump, thereby increasing operator safety at jobsites, without inhibiting access to other parts and components of the pump. Furthermore, the exemplary embodiment for the eccentric pushrod cover device also allows the operator to efficiently access areas shielded by the eccentric pushrod cover device by leveraging its modular design such that select elements can be detached without requiring detachment of the entire eccentric pushrod cover device.

BRIEF SUMMARY OF THE INVENTION

An exemplary embodiment of the present invention provides an eccentric pushrod cover device for a high-volume double diaphragm pump.

The eccentric pushrod cover device, hereinafter referred to as the pushrod cover, mitigates the risk of injury of an operator during operation of the high-volume double diaphragm pump, hereinafter referred to as the pump, by shielding the eccentrically driven pushrods. The pushrod cover is comprised of a plurality of components that enable it to be retrofitted onto existing pumps as well as implemented into the manufacture of new pumps. Furthermore, the device's modularity allows for easy intermittent access to the pushrods and adjacent parts when needed.

The pushrod cover provides a mounting plate, saddle plate, and face plate. The saddle plate is comprised of three sides that include a top side, first side, and second side. The saddle plate additionally provides a plurality of saddle plate through holes on all three of its sides. The mounting plate provides a profile that allows it to be installed directly to a gearbox of the pump without requiring the dismantling or modification of any of the pump's parts or components. The mounting plate and face plate each respectively provide a plurality of flanges that are concealed beneath the saddle plate when the saddle plate is installed. The plurality of flanges provides a plurality of through holes that align with through holes provided by the saddle plate, thereby allowing the saddle plate to attach to the mounting plate and the face plate.

The face plate provides elliptical shaped slotted cutouts that allow the pushrod and its connection to the eccentric to be visible when the pushrod cover is installed. Additionally, the elliptical slotted cutouts provided by the face plate allow for sufficient air flow to dissipate heat generated by the gearbox and pushrod during operation.

NUMBERING REFERENCE

5—Eccentric pushrod cover device
10—Gearbox
11—Plurality of gearbox fasteners
15—Pushrod
16—High-volume diaphragm
20—Mounting plate
20*a*—Mounting plate top flange
20*b*—Mounting plate first side flange
20*c*—Mounting plate second side flange
21—Plurality of mounting plate through holes
22*a*—First plurality of saddle plate through holes
22*b*—Plurality of mounting plate flange through holes
23*a*—Second plurality of saddle plate through holes
23*b*—Plurality of face plate flange through holes
25—Saddle plate
25*a*—Top plate
25*b*—First side plate
25*c*—Second side plate
26—Plurality of saddle plate fasteners
30—Face plate
30*a*—Face plate top flange
30*b*—Face plate first side flange
30*c*—Face plate second side flange
31—Plurality of slotted cutouts
40—Outlet chamber

DETAILED DESCRIPTION OF THE EMBODIMENTS

Figure 5:
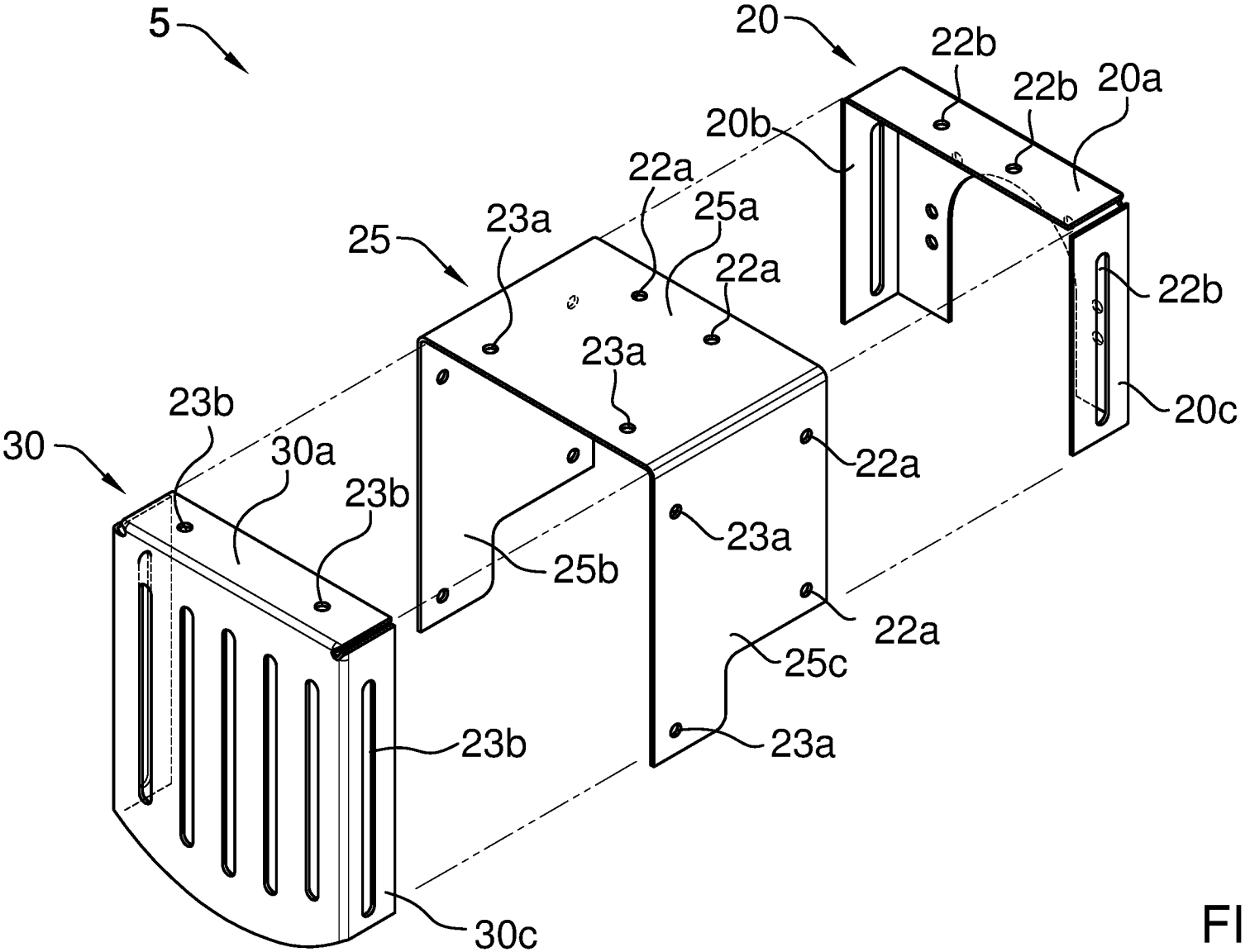
FIG. 5 is an exploded isometric view of the eccentric pushrod cover device.

A non-limiting exemplary embodiment of the present invention provides an eccentric pushrod cover device 5 for a pair of eccentrically driven pushrods 15 each used to actuate a high-volume diaphragm 16 within a high-volume double diaphragm pump, hereinafter referred to as the pump. The eccentric pushrod cover device 5, hereinafter referred to as the pushrod cover 5, comprises a pair of inverted basket-shaped assemblies that each further comprise a mounting plate 20, a saddle plate 25, and a face plate 30, as shown in FIG. 5. A modular design of the pushrod cover 5 allows the face plate 30 to be detached from the saddle plate 25 without detaching the entire pushrod cover 5 from the pump. The modular design of the pushrod cover 5 additionally allows for the pushrod cover 5 to be retrofitted onto a gearbox 10 provided by the pump.

Figure 6:
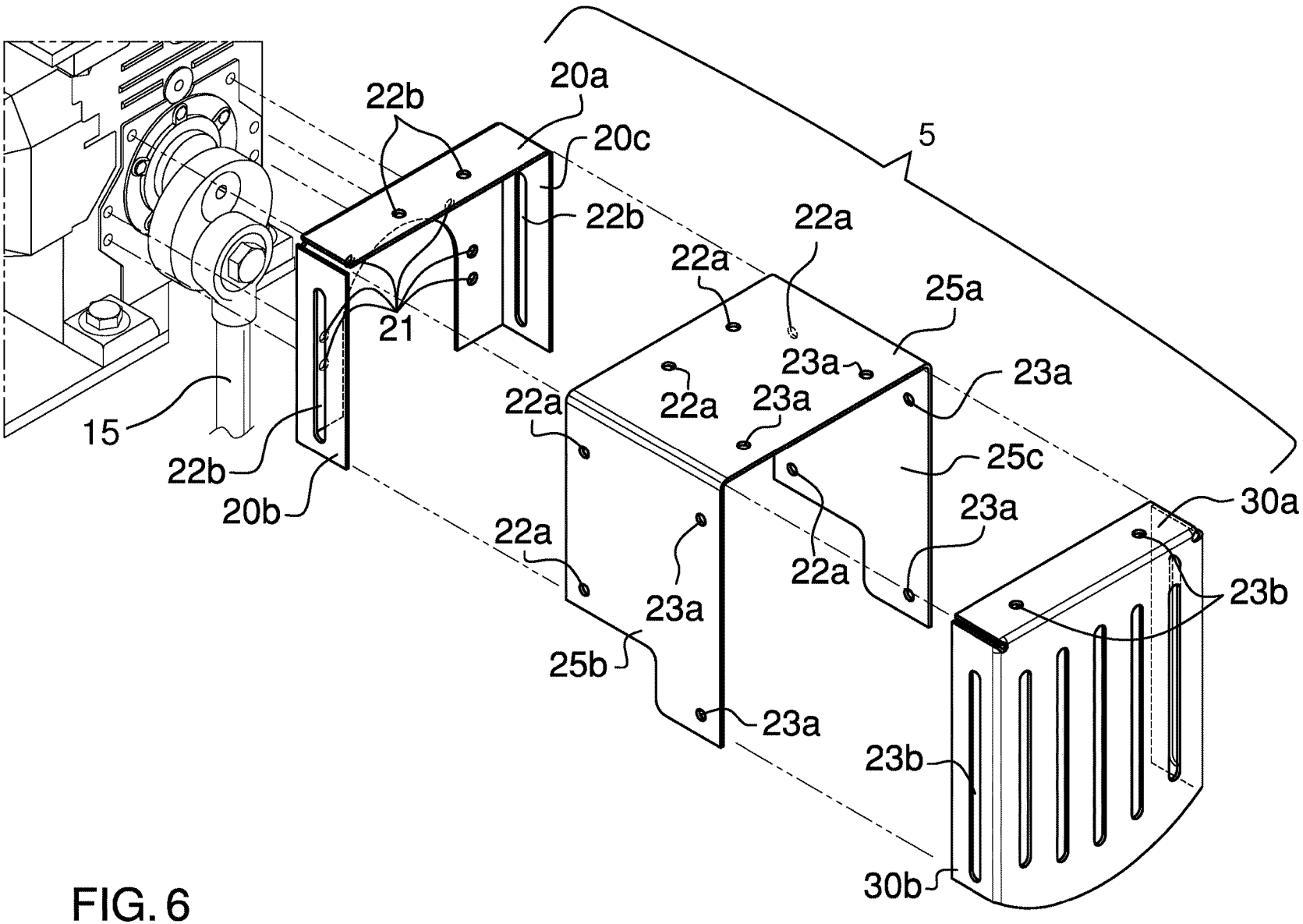
FIG. 6 is an exploded isometric view of the eccentric pushrod cover device.

The mounting plate 20 is attached directly to the gearbox 10 using a plurality of gearbox fasteners 11. The pushrod cover 5 is designed to accommodate the existing configuration of the pushrod 15 and the gearbox 10. As such, each mounting plate 20 provides an arch-shaped profile. Each mounting plate 20 comprises a plurality of mounting plate through holes 21 that are aligned with a plurality of fastener holes provided by the sides of the gearbox 10 that each mounting plate 20 attach to, as shown in FIG. 6. The mounting plate 20 provides a mounting plate top flange 20*a*, a mounting plate first side flange 20*b*, and a mounting plate second side flange 20*c*, as shown in FIG. 5. The mounting plate flanges 20*a*, 20*b*, 20*c* increase the stiffness of the mounting plate 20 and allow for the saddle plate 25 to attach and detach from the mounting plate 20. The mounting plate flanges 20*a*, 20*b*, 20*c* each respectively provide a plurality of mounting plate flange through holes 22*b*.

Figure 1:
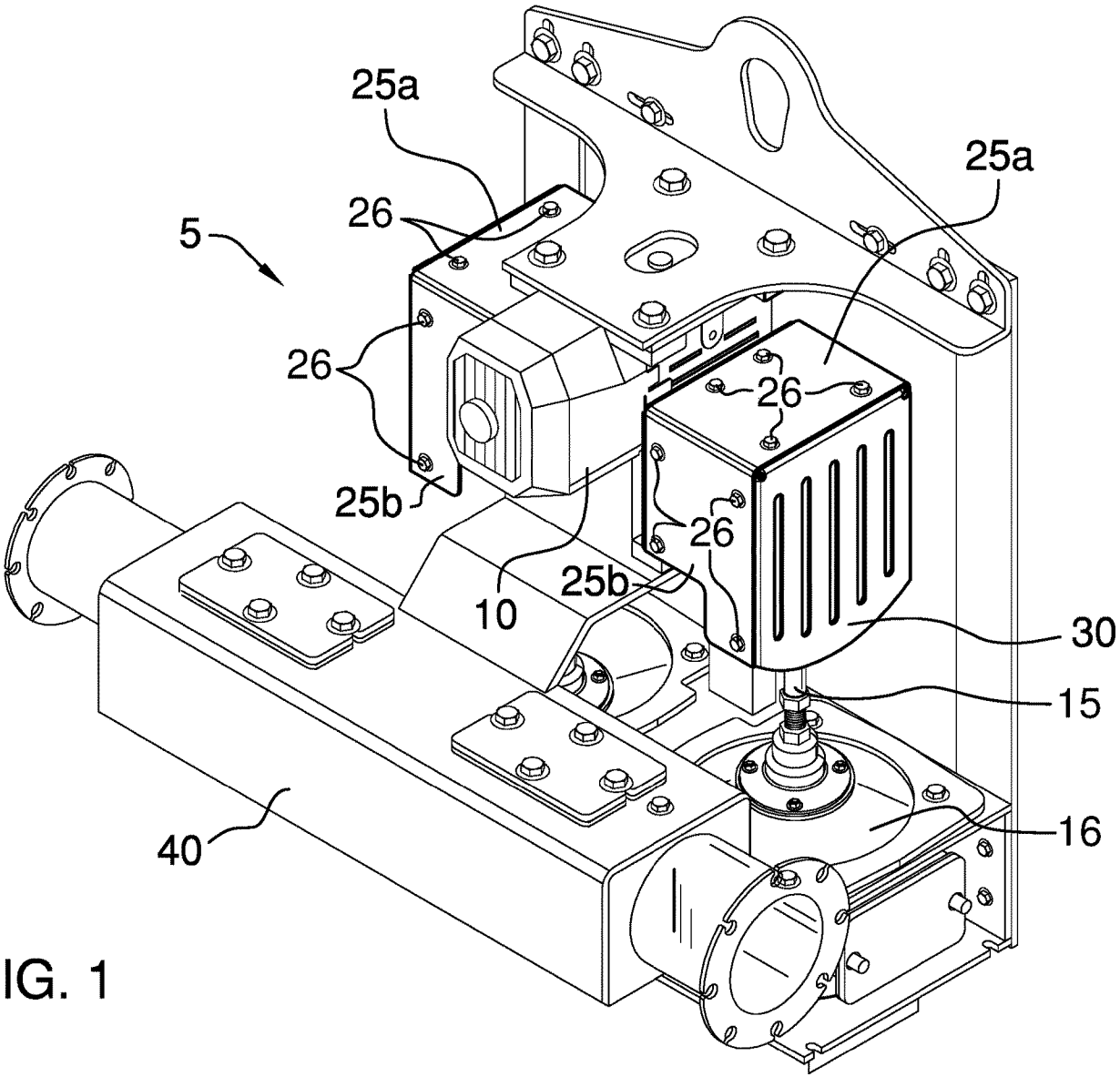
FIG. 1 is an in-use isometric view of an eccentric pushrod cover device.
Figure 2:
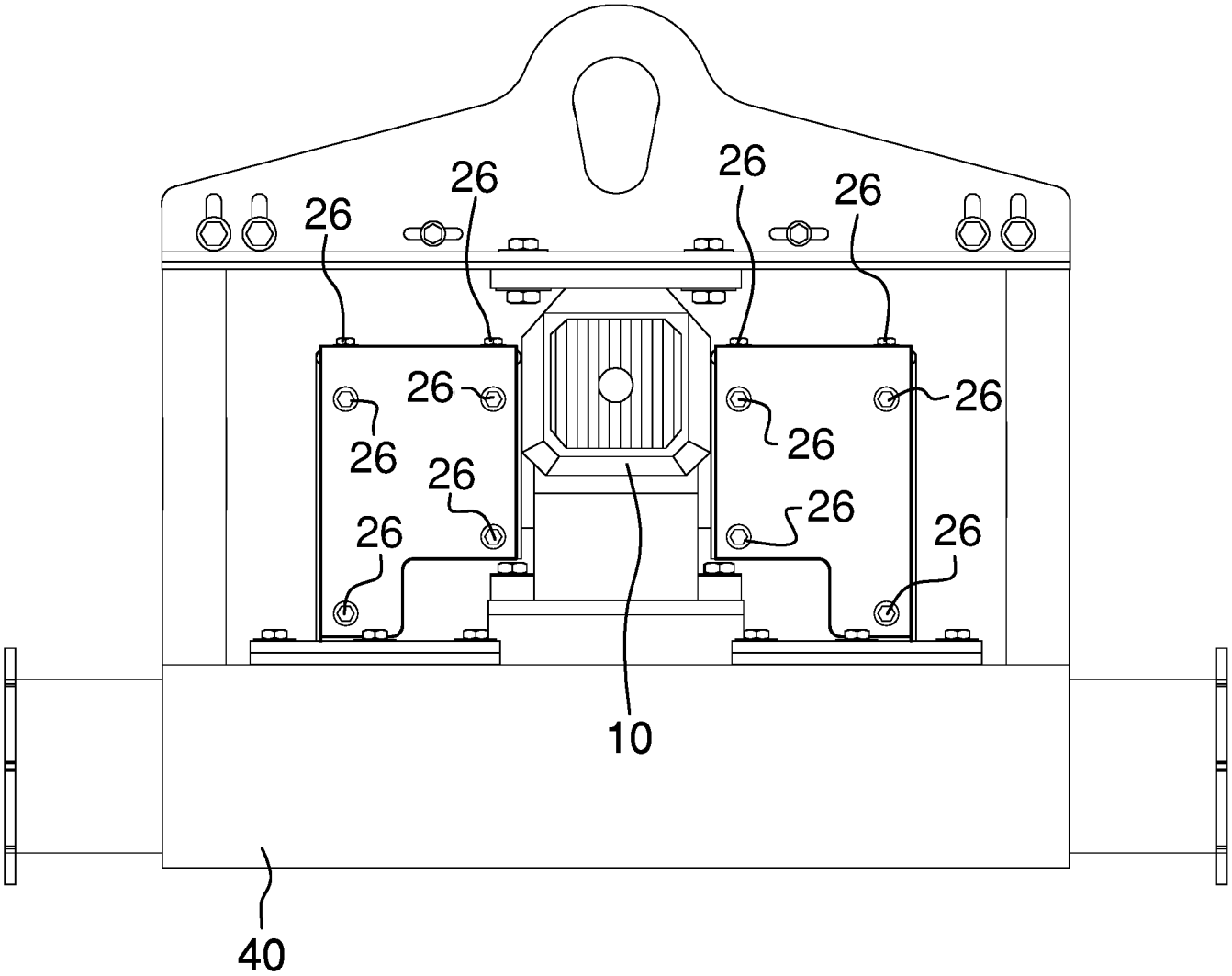
FIG. 2 is an in-use side view of the saddle plate provide by the eccentric pushrod cover device.
Figure 3:
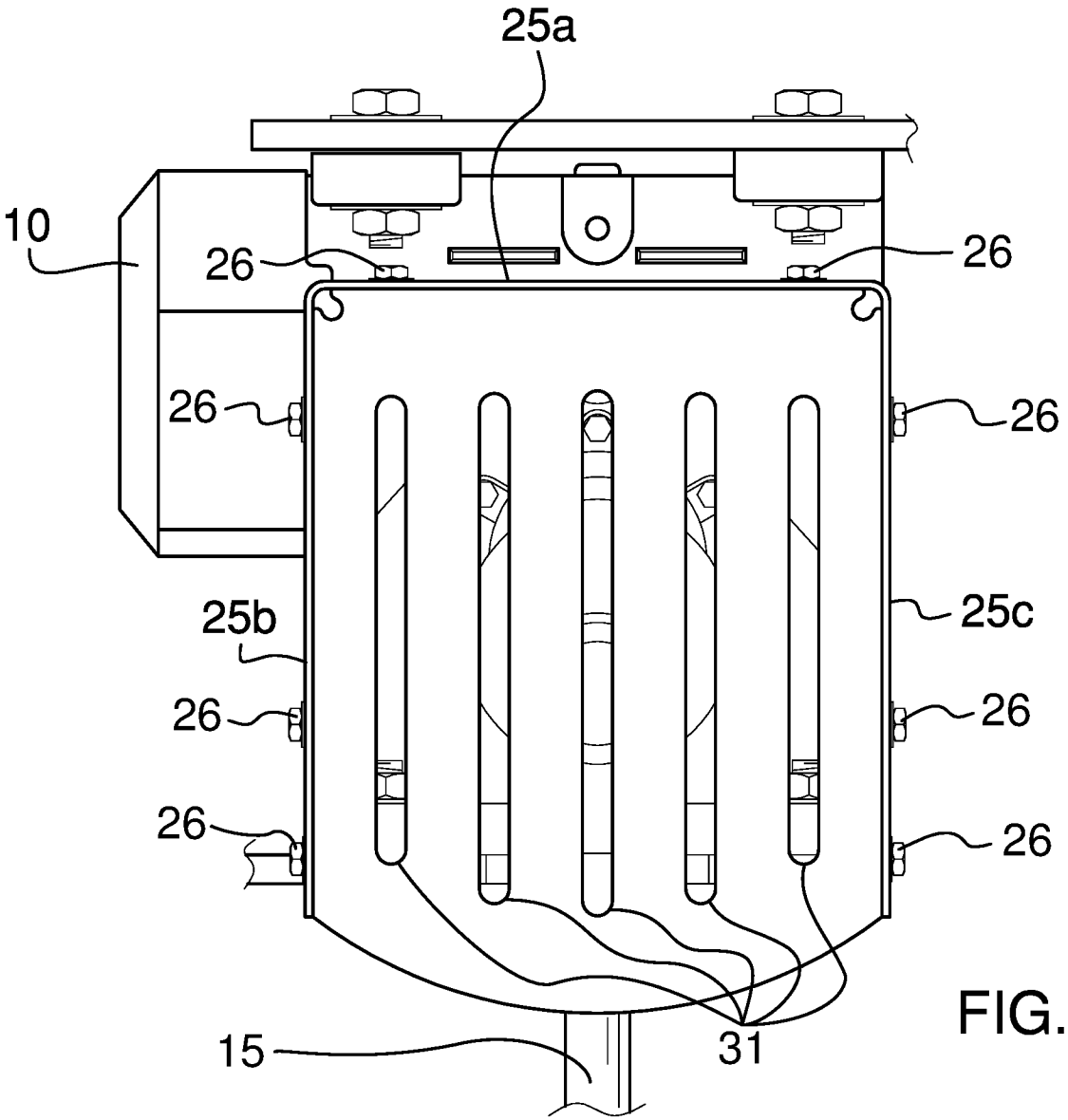
FIG. 3 is an in-use front view of the face plate provided by the eccentric pushrod cover device.
Figure 4:
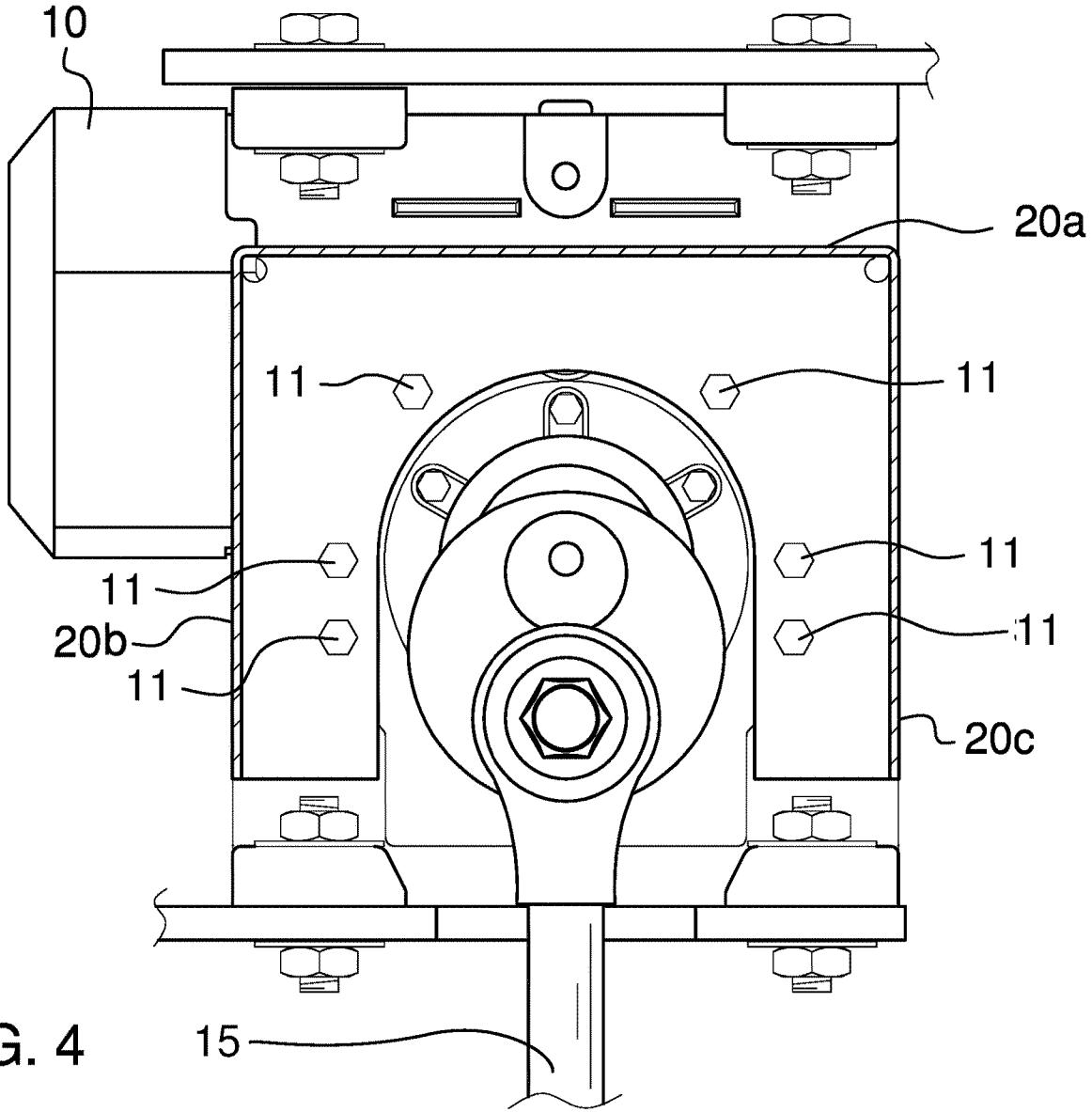
FIG. 4 is a front view of the mounting plate provided by the eccentric pushrod cover device attached to the gearbox.

The saddle plate 25 is comprised of a top plate 25*a*, a first side plate 25*b*, and a second side plate 25*c*. The saddle plate 25 provides first plurality of saddle plate through holes 22*a* and a second plurality of saddle plate through holes 23*a*, as shown in FIG. 5 and FIG. 6. The first plurality of saddle plate through holes 22*a* is provided nearest to the gearbox 10 relative to the second plurality of saddle plate through holes 23*a*, as shown in FIG. 6. The first plurality of saddle plate through holes 22*a* is positioned such that when the saddle plate 25 is installed over the mounting plate flanges 20*a*, 20*b*, and 20*c* they are aligned with the plurality of mounting plate flange through holes 22*b*. As shown in FIG. 5, the first side plate 25*b* and second side plate 25*c* are substantially parallel to each other and are substantially orthogonal to the top plate 25*a*. In the exemplary embodiment the top plate 25*a* is substantially flat, as shown in FIG. 1.

The flat profile of the top plate 25*a* provides a secure surface to which a worker could stand or place items on while the pump 5 is not in operation. This is useful for maintenance as well as attaching and detaching a hook to the lifting bail. However, it is anticipated that the top plate 25*a* may be sloped or curved.

The integral attachment of the first side plate 25*b* and second side plate 25*c* respectively to the top plate 25*a* increases the stiffness of the saddle plate 25 as well as overall stability of the pushrod cover 5. The first side plate 25*b* and second side plate 25*c* each provide a notch at the bottom corner that is nearest to the gearbox 10 as shown in FIG. 6. The notch within each of the side plates 25*b*, 25*c* are provided to accommodate the existing pump configuration that within the exemplary embodiment provides the gearbox 10 at an elevated position relative to each of the high-volume diaphragms 16. Furthermore, while the exemplary embodiment of the pushrod cover 5 does not provide a top plate 25 with slotted cutouts it is anticipated that slotted cutouts may be provided in alternative embodiments.

The face plate 30 provides a plurality of face plate flanges that comprise a face plate top flange 30*a*, a face plate first side flange 30*b*, and a face plate second side flange 30*c*, as shown in FIG. 5 and FIG. 6. The face plate flanges 30*a*, 30*b*, 30*c* increase the stiffness of the face plate 30 and allow for the face plate 30 to attach and detach from the saddle plate 25. The face plate flanges 30*a*, 30*b*, 30*c* provide a plurality of face plate flange through holes 23*b* that align with the second plurality of saddle plate through holes 23*a*. The face plate 30 provides a plurality of slotted cutouts 31 that allow the pushrod 15 and components of the pump shielded by the pushrod cover 5 to be visible while the pushrod cover 5 is installed.

In an exemplary embodiment of eccentric pushrod cover device 5 it is preferable that the saddle plate 25 overlap the mounting plate flanges 20*a*, 20*b*, 20*c* as well as the face plate flanges 30*a*, 30*b*, 30*c*. The modular assembly of the pushrod cover 5, and particularly the face plate 30, allows for quick access to the pushrod 15 as well as adjacent parts of the pump that are shielded by the pushrod cover 5. It is also anticipated that the plurality of slotted cutouts 31 provided by the face plate 30 allow for additional pump accessories to be retrofitted onto the face plate 30.

While the embodiments of the invention have been disclosed, certain modifications may be made by those skilled in the art to modify the invention without departing from the spirit of the invention.

The inventor claims:

1. An eccentric pushrod cover device for a high-volume double diaphragm pump comprising:

a. a mounting plate;
- wherein the mounting plate provides an arch-shaped profile;
- wherein the mounting plate provides a plurality of mounting plate through holes;
- wherein the mounting plate provides a plurality of mounting plate flanges integrally formed with the mounting plate;
- wherein the plurality of the mounting plate flanges comprises a mounting plate top flange, a mounting plate first side flange, and a mounting plate second side flange;
- wherein the plurality of the mounting plate flanges provides a plurality of mounting plate flange through holes;

b. a face plate;
- wherein the face plate provides a plurality of flanges integrally formed with the face plate;
- wherein the plurality of flanges of the face plate comprises a face plate top flange, a face plate first side flange, and a face plate second side flange;
- wherein the plurality of flanges provides a plurality of face plate flange through holes;
- wherein the face plate provides a plurality of slotted cutouts;

c. a saddle plate;
- wherein the saddle plate provides a plurality of sides;
- wherein the plurality of sides comprises a top plate, a first side plate, and a second side plate;
- wherein the top plate, first side plate, and second side plate each respectively provide a first plurality of saddle plate through holes and a second plurality of saddle plate through holes;
- wherein the first plurality of saddle plate though holes aligns with the plurality of mounting plate flange through holes;
- wherein the second plurality of saddle plate through holes aligns with the plurality of face plate flange through holes;
- wherein the saddle plate is attached to the mounting plate;
- wherein the saddle plate is attached to the face plate.

2. The eccentric pushrod cover device of claim 1, wherein the first side plate and second side plate of the saddle plate are substantially parallel to each other.

3. The eccentric pushrod cover device of claim 1, wherein the first side plate and second side plate of the saddle plate are substantially orthogonal to the top plate of the saddle plate.

4. The eccentric pushrod cover device of claim 1, wherein the mounting plate is attached to a side of a gearbox.

5. The eccentric pushrod cover device of claim 1, wherein the mounting plate is attached to a side of a gearbox with a plurality of fasteners.

6. The eccentric pushrod cover device of claim 1, wherein the saddle plate is of unitary construction.

7. The eccentric pushrod cover device of claim 1, wherein the mounting plate is of unitary construction.

8. The eccentric pushrod cover device of claim 1, wherein the face plate is of unitary construction.

* * * * *